US006886226B1

(12) United States Patent
Dear et al.

(10) Patent No.: US 6,886,226 B1
(45) Date of Patent: May 3, 2005

(54) RIVETING APPARATUS

(75) Inventors: Robert A. Dear, Herts (GB); Angraj K. Seewraj, Herts (GB); Richard P. King, Herts (GB); Egbert Frenken, Wermelskirchen (DE)

(73) Assignees: Textron Fastening Systems Limited (GB); part interest; Gustav Klauke, GmbH (DE); part interest ( * ) Notice: Subject to any disclaimer, the term of this patent is extended or adjusted under 35 U.S.C. 154(b) by 0 days.

(21) Appl. No.: 10/089,490

(22) PCT Filed: Sep. 27, 2000

(86) PCT No.: PCT/GB00/03703

§ 371 (c)(1),
(2), (4) Date: Jun. 21, 2002

(87) PCT Pub. No.: WO01/24956

PCT Pub. Date: Apr. 12, 2001

(30) Foreign Application Priority Data

Oct. 2, 1999 (GB) ..... 9923266

(51) Int. Cl.[7] ..... B21J 15/36
(52) U.S. Cl. ..... 29/243.53; 227/55
(58) Field of Search ..... 227/10, 55, 130, 227/134; 29/243.525, 243.524, 243.53; 72/453.19

(56) References Cited

U.S. PATENT DOCUMENTS 3,254,522 A * 6/1966 Elliott et al. ..... 29/243.525
3,502,028 A * 3/1970 Coper ..... 417/404
3,616,673 A * 11/1971 Miklos ..... 29/798
5,195,354 A * 3/1993 Yasui et al. ..... 72/453.03
5,473,805 A 12/1995 Wille
5,553,478 A * 9/1996 Di Troia ..... 72/453.15
5,682,659 A 11/1997 Chang
5,706,541 A * 1/1998 Gutelius et al. ..... 15/22.1
5,875,629 A * 3/1999 Kimura ..... 60/329
5,953,822 A * 9/1999 Vogelsanger ..... 30/228
5,993,402 A * 11/1999 Sauer et al. ..... 601/162
6,148,507 A * 11/2000 Swanson et al. ..... 29/816
6,276,186 B1 * 8/2001 Frenken ..... 72/453.15
6,301,948 B1 * 10/2001 Weiland ..... 72/391.6

FOREIGN PATENT DOCUMENTS

| | | |
|---|---|---|
| EP | 936006 | 8/1999 |
| GB | 2301547 | 12/1996 |
| WO | WO 99/65630 | * 12/1999 |

* cited by examiner

*Primary Examiner*—Eugene Kim
*Assistant Examiner*—Paul Durand
(74) *Attorney, Agent, or Firm*—Trexler, Bushnell, Giangiorgi, Blackstone & Marr, Ltd.

(57) ABSTRACT

A hand-held riveting tool is driven by a battery-powered electric motor, and comprises a hydraulically-actuated riveting head, and a reciprocating hydraulic pump driven by the electric motor. The tool includes a reservoir for hydraulic fluid, the hydraulic supply line from the pump to the riveting head being connected to the reservoir by a reservoir inlet valve which is normally open to allow hydraulic fluid to flow from the supply line into the reservoir. Operation of the tool-actuating trigger firstly closes the reservoir inlet valve, and then switches on the electric motor to operate the pump. Release of the tool-actuating trigger firstly switches off the electric motor to stop operation of the pump, and then opens the reservoir inlet valve. When the reservoir inlet valve is closed by operation of the trigger, it acts as a pressure-relief valve to relieve over-pressure of hydraulic fluid.

7 Claims, 5 Drawing Sheets

RIVETING APPARATUS

RELATED/PRIORITY APPLICATIONS

This application claims priority with respect to International Application No. PCT/GB00/03703, filed Sep. 27, 2000 and British Application No. 9923266.2, filed Oct. 2, 1999.

BACKGROUND OF THE INVENTION

The present invention relates to riveting apparatus, and more particularly to hand-held riveting apparatus of the type in which is driven by a battery-powered electric motor.

One such form of apparatus is described in U.S. Pat. No. 5,473,805. This is a tool for riveting by means of blind breakstem rivets of the well-known type in which the rivet is placed by pulling a breakable stem with respect to a tubular body. The pulling head includes a reciprocable element, which is permanently connected to the electric motor by means of a mechanical gearbox, the electric motor being reversible in order to reverse the movement of the reciprocable element. Riveting tools according to U.S. Pat. No. 5,473,805 have found acceptance in industry, but however they have the disadvantage of being relatively inefficient.

The present invention aims to allow the design and construction of riveting apparatus which is more efficient.

BRIEF SUMMARY OF THE INVENTION

The invention provides, in one of its aspects, a hand-held riveting tool as defined in claim 1 of the appended claims. Further features of the invention are defined in the various sub-claims.

A specific embodiment of the invention will be described by way of example and with reference to the accompanying drawings in which:

DETAILED DESCRIPTION OF THE INVENTORY

Figure 1:
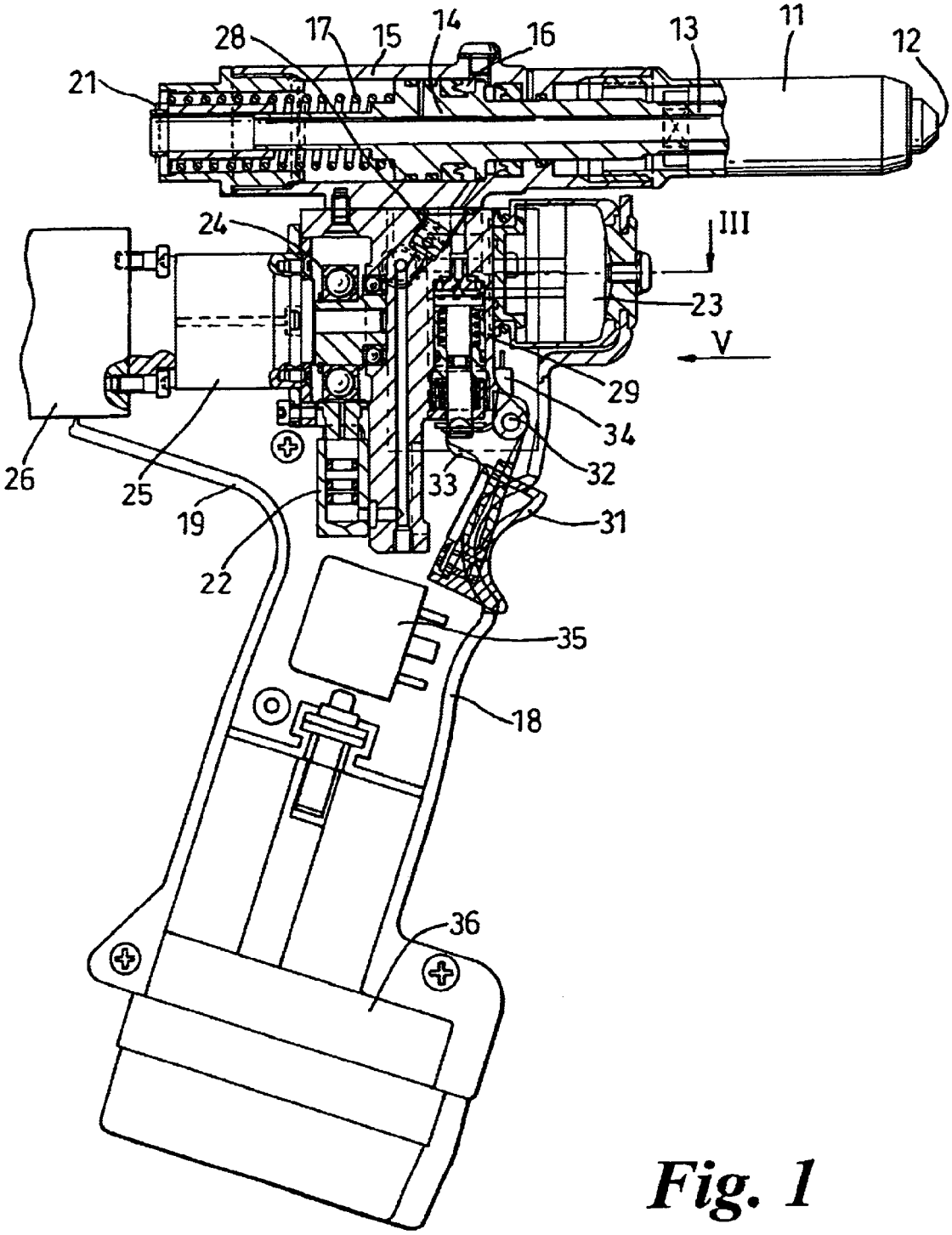
FIG. 1 is a section through a hand-held battery-powered breakstem blind riveting tool.
Figure 2:
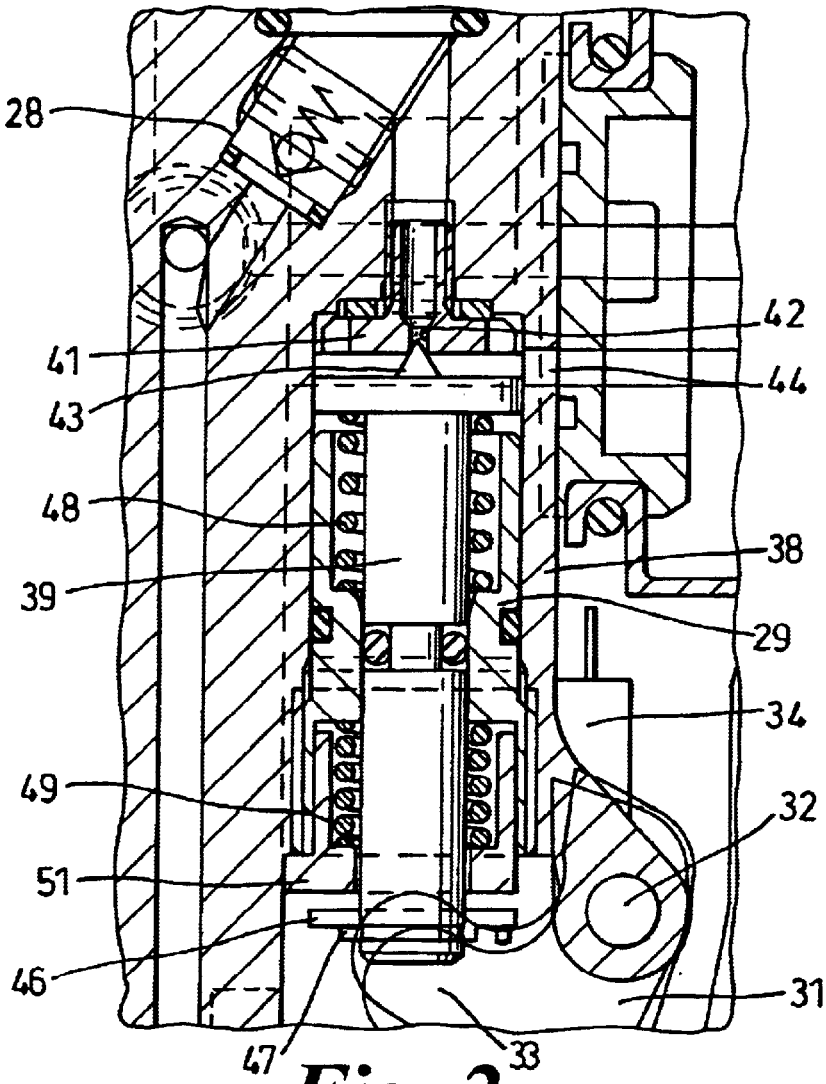
FIG. 2 is an enlargement of part of FIG. 1.
Figure 3:
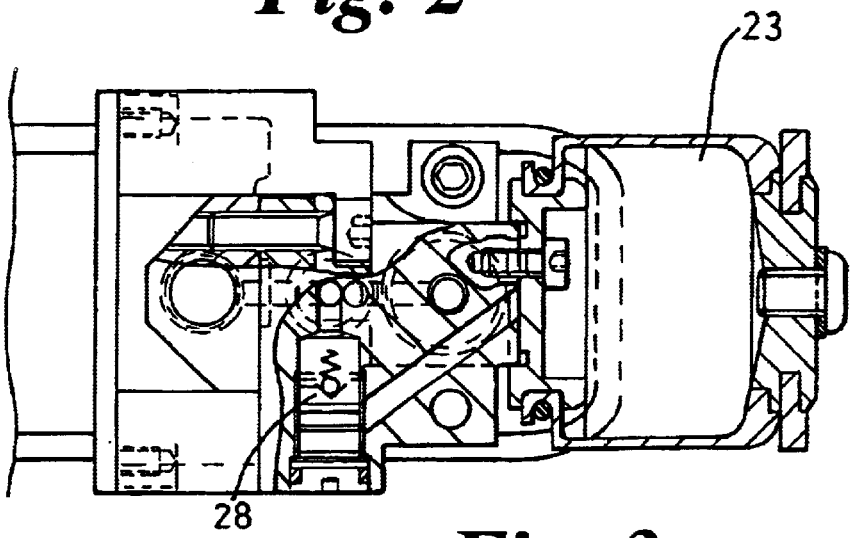
FIG. 3 is a view on the line III of FIG. 1.

The hand-held tool of this example is conventional in its general layout. It includes a breakstem riveting head 11 with an annular nosetip anvil 12 for supporting the shell head of a blind breakstem rivet (such as that available in many countries under the Registered Trade Mark AVEX). the protruding stem of which is gripped by reciprocable jaws (not shown) carried by the forward end of a reciprocable drawbar 13. The rear end of the drawbar is connected to a head piston 14 reciprocable in a hydraulic cylinder 15. The piston 14 is actuated to place a rivet by supplying hydraulic fluid under pressure to the cylinder space 16 in front of the piston. After placing of a rivet the piston is returned forwardly by a spring 17. A suitable receptacle (not shown) may be attached to the rear end 21 of the head, to receive broken-off parts of rivet stems. The operation of the riveting head 11 is conventional.

Figure 6:
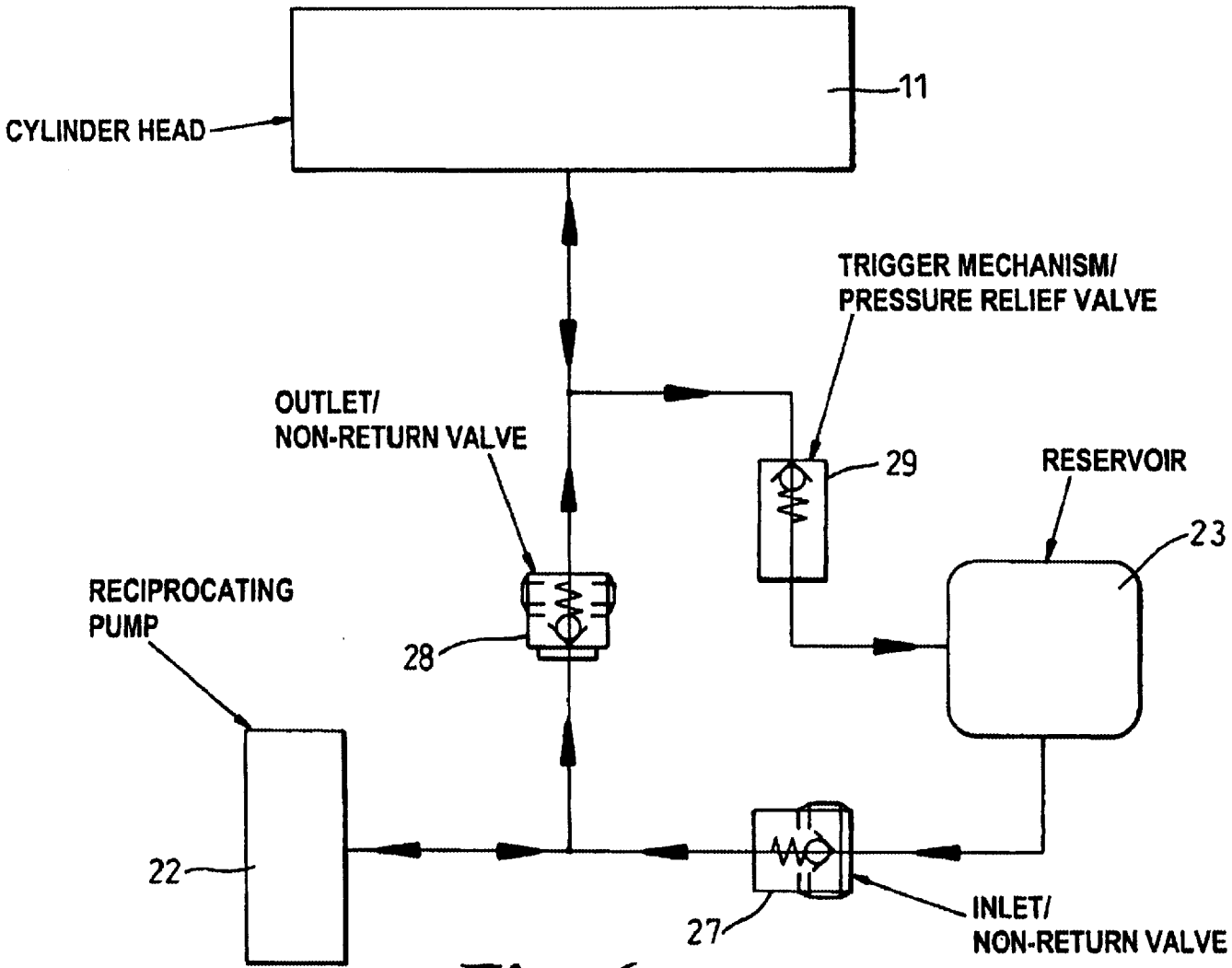
FIG. 6 is a schematic block diagram of the hydraulic circuitry of the tool.

The tool includes a reciprocating hydraulic pump 22 and a reservoir 23 for hydraulic fluid. The pump is operated by an eccentric cam 24, which is rotated, through a reduction gearbox 25, by means of an electric motor 26. When the pump is operated it draws hydraulic fluid from the reservoir 23 through an inlet non-return valve 27, and supplies hydraulic fluid to the riveting head 11 through an outlet non-return valve 28. A further trigger-operated reservoir inlet valve 29 is also connected, as shown in FIG. 6, between the outlet side of the outlet non-return valve 28 and the reservoir 23.

The reservoir inlet valve 29 is normally open so that it allows hydraulic fluid to flow from the head space 16, to the reservoir 23. The valve 29 is closed by actuation of a trigger 31 which is pivoted at 32 to the body of the tool, and carries a pair of projections 33 which contact the valve 29 in order to actuate it.

Mounted adjacent the trigger-operated valve 29 is an electrical switch 34 (FIG. 4), which is connected by means of electrical wiring (not shown) to actuate a relay 35 to connect a battery 36, housed at the bottom end of the pistol grip 18, to actuate the motor 26 to drive the pump 22.

The arrangement of the trigger 31, valve 29 and switch 34 is such that, when the trigger 31 is progressively depressed by progressively increasing force from the finger of an operator grasping the pistol grip 18, firstly the valve 29 is closed, thereby preventing flow of hydraulic fluid into the reservoir 23, and thereafter the switch 34 is closed, thereby starting the electric motor 26 and the pump 22. When the trigger 31 is released, firstly the switch 34 opens to shut off the electric motor 26 and pump 22, and thereafter the valve 29 is opened. Moreover, it is arranged that during the time when the valve 29 is closed as just described, nonetheless it can still operate as a pressure relief valve to relieve into the reservoir any dangerously high pressure of hydraulic fluid which may build up. As previously mentioned, the switch 34 is mounted adjacent the valve 29, so that the actuating button 37 of the switch (see FIG. 4) is actuated by a moving part of the valve 29 which is moved by operation of the trigger 31.

FIG. 4 shows the construction and operation of the valve 29. It comprises a generally cylindrical tubular body 38 in which can reciprocate a generally cylindrical valve member 39. In the top end wall 41 of the valve body 38 is a circular inlet port 42, which can be closed by means of a conical projection 43 at the top of the valve member 39. When the inlet port 42 is open it communicates with a lateral outlet 44 to allow hydraulic fluid into the reservoir 23. Around the lower part of the valve member 39 is a sleeve 45, the lower end of which protrudes from the valve body 38 and bears against a washer 46 held on to the lower end of the valve member 39 by a circlip 47. The lower end of the sleeve 45 is enlarged into a flange 51 which has a transverse extension in the form of a lug 52 (FIG. 5). The trigger projections 33 contact the underside of the sleeve flange 51, and the projecting lug 52 is aligned under the switch 34 so that the lug can contact the switch button 37 to actuate the switch, as will be described later.

The valve member 39 is urged upwardly into the closed position by means of a first helical spring 48 acting between the valve body 29 and the upper end of the valve member 39. It is urged downwardly into the open position by means of a second helical spring 49, acting between the valve body 29 and the sleeve 45, and thereby through the washer 46 and circlip 47 on the valve member 39.

Figure 4A:
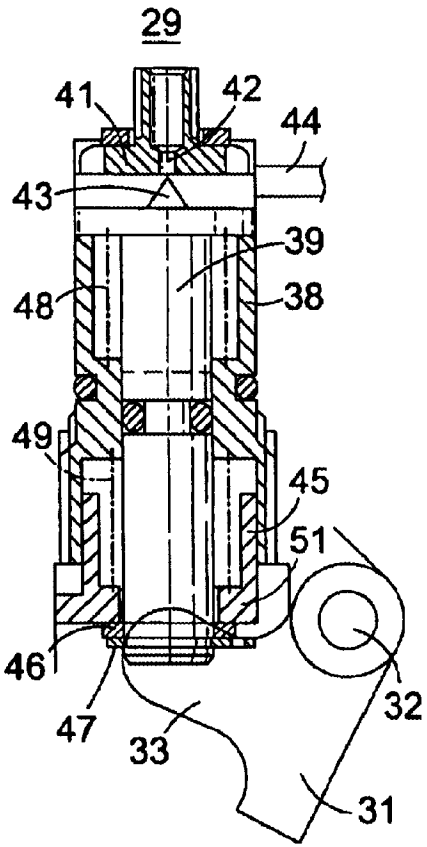
FIGS. 4A, 4B and 4C show progressive positions of the reservoir inlet valve.
Figure 4D:
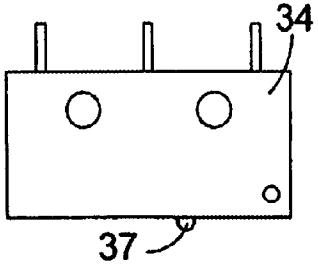
Figure 4B:
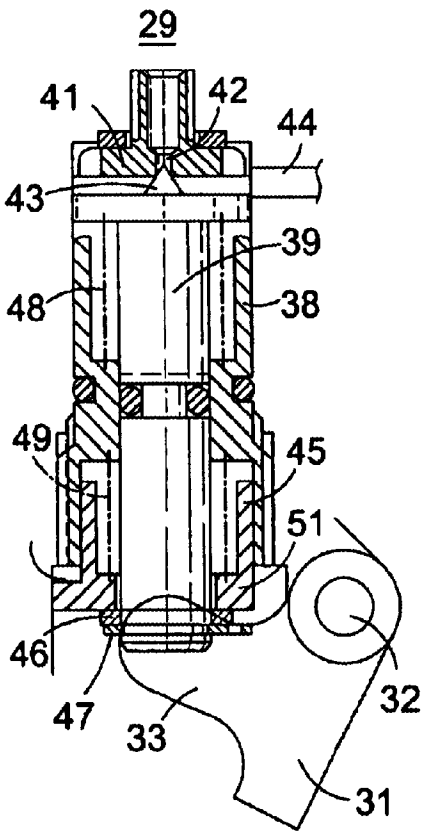
Figure 4C:
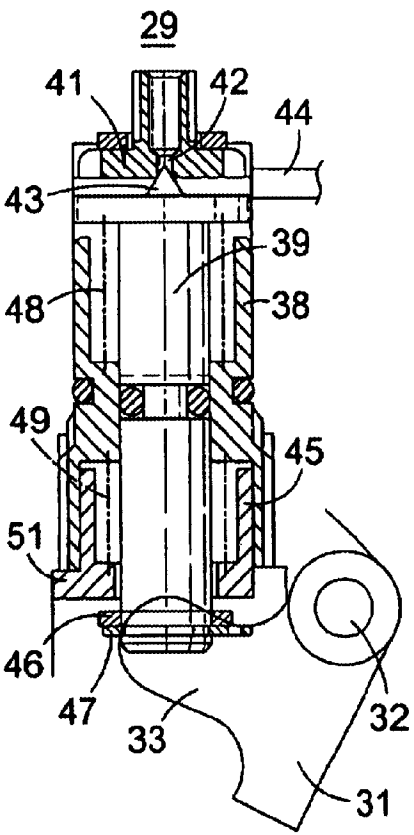
Figure 5:
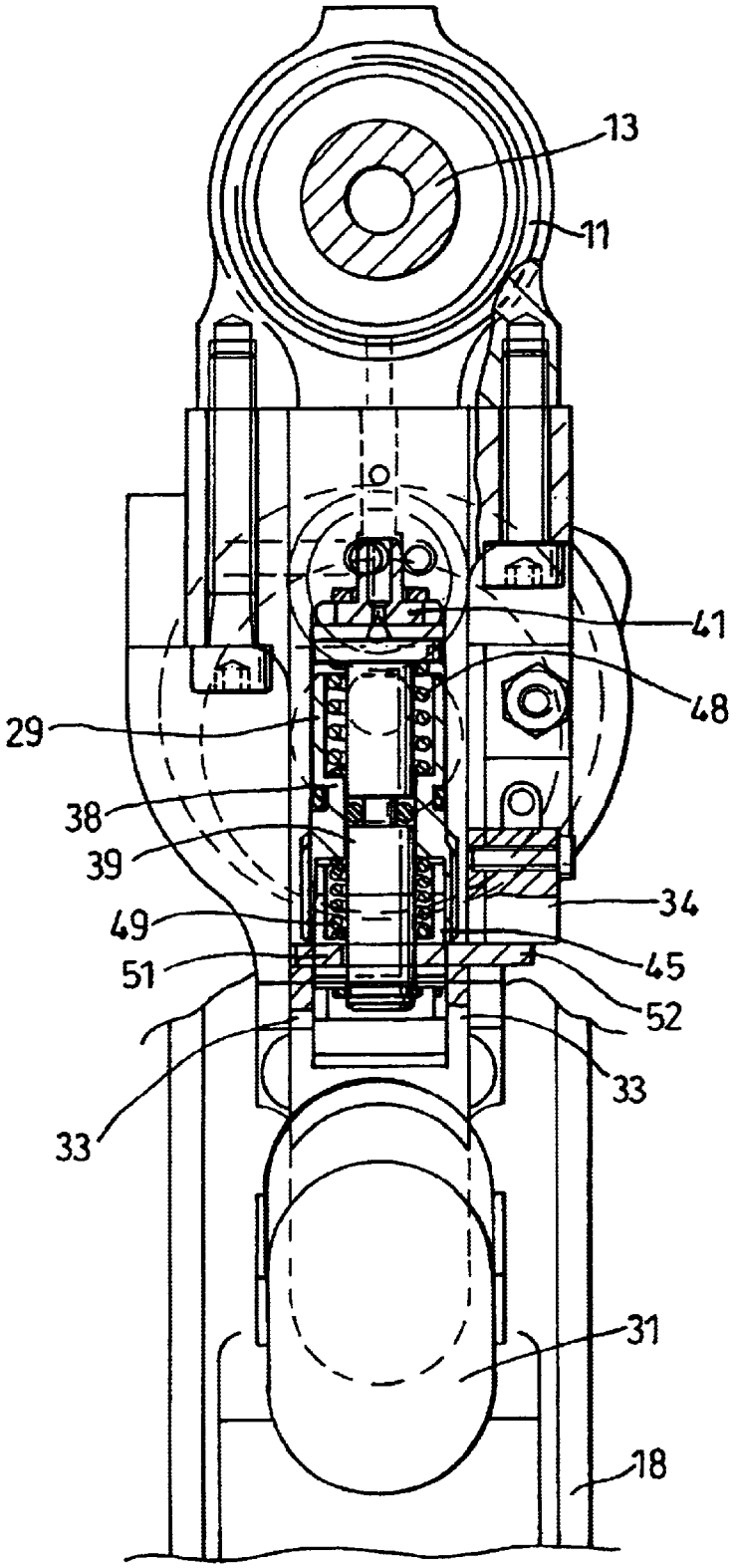
FIG. 5 is an enlarged partly sectional, view in the direction of the arrow V in FIG. 1.

The two springs 48 & 49 are identical, so that the valve member 39 is normally held "floating" in the open position, as shown in FIG. 4A. FIGS. 4A, 4B and 4C are aligned vertically with each other to illustrate the relative positions of the sleeve 45, valve member 39 and trigger 31 at different stages in the progressive operation of the trigger 31. FIG. 4 also illustrates the relative vertical alignment (but not the horizontal alignment) of the switch 34 and its button 37. FIG. 4A shows the position with the trigger 31 not operated. i.e. in its rest position; the sleeve 45 is held in its lowest position by the second spring 49, and the valve member 39 is in its lowest or open position as explained above, and the switch 34 is not actuated, i.e. it is in its "off" position.

When the operator actuates the trigger by applying a progressively increasing force to it, the projections 33 bear on the flange 51 of the sleeve 45, to push it upwards, thus progressively compressing the second spring 49 and allowing the first spring 48 to progressively push the valve member upwards, towards its closed position. FIG. 4B illustrates the valve member 39 in its fully closed position, with the conical projection 43 sealing the inlet part 42 under the urging of the first spring 47. The switch 34 is still not actuated, i.e. it is still in its "off" position.

As the operator applies still more force to the trigger 31, the projections 33 apply more force to the bottom of the sleeve 45, and lifts the sleeve 45 out of contact with the washer 46, whilst compressing the second spring 49 even further. When the sleeve 45 has left contact with the washer 46, the second spring 49 no longer has any effect in reducing the closing force exerted by the first spring 48 on the valve member 39. Hence the closing force on the valve is a predetermined known value, so that the valve will operate as a pressure relief valve at a predetermined over-pressure of the hydraulic fluid. This will allow hydraulic fluid to be safely returned to the reservoir 23, regardless of sustained operation of the tool actuating device, i.e. if the operator keeps the trigger 31 depressed for a long time so that the head piston 14 contacts the cylinder cap.

As the sleeve 49 continues to rise in this way, its projecting lug 52 actuates the button 37 of the switch 34. This starts the electric motor 26, which operates the pump 22. This applies hydraulic fluid under pressure to the space 16 on the pulling head 11, thus actuating the head mechanism to place a rivet, the drawbar 13 being retracted against the urging of spring 17. When the rivet has been placed, the operator releases the force on the trigger 31. The sequence of movements described above is reversed. Firstly the sleeve 45 descends, allowing the switch 34 to turn off and stop the pump 28. Then the valve member 39 is allowed to move away from the inlet part 42, thus allowing hydraulic fluid to be ejected from the head cylinder space 16 by piston 14 under the urging of spring 17, and into the reservoir 23. The piston 14, drawbar 13 and the riveting head are thus returned to their initial positions by the spring 17, and not by the electric motor 26. Thus the electric motor, in use, rotates in only one direction. The valve 29 returns to its rest position illustrated in FIG. 4A.

It is found that a battery operated hand-held riveting tool as described above is substantially more efficient than the prior art tool referred to in the preamble due to the conversion of rotary motion to linear motion by hydraulic means instead of mechanical means, and the use of a uni-directional electric motor, i.e. one which is electrically actuated so as to rotate in only one direction, i.e. to actuate the riveting head, but not to return the riveting head its initial position.

The invention is not restricted to the details of the foregoing example. For instance, it could be applied to a tool for a form of riveting, other than blind breakstem riveting, e.g. blind repetition pull-through riveting, the installation of threaded inserts, or self-piercing riveting.

What is claimed is:

1. A hand-held riveting tool driven by a battery-powered electric motor, comprising a hydraulically-actuated riveting head, and a hydraulic pump driven by the electric motor, whereby when the motor is operated it drives the hydraulic pump to actuate the riveting head, the tool including a tool-actuating device such as a trigger, and also including a reservoir for hydraulic fluid, the hydraulic supply line from the pump to the riveting head being connected to the reservoir by a reservoir inlet valve which is normally open to allow hydraulic fluid to flow from the supply line into the reservoir, in which operation of the tool-actuating device firstly closes the reservoir inlet valve, and then switches on the electric motor to operate the pump; and in which the reservoir inlet valve when closed by operation of the tool-actuating device as aforesaid also acts as a pressure-relief valve to relieve over-pressure of hydraulic fluid; and in which the reservoir inlet valve is urged closed by a first spring with a fist predetermined force and is urged open by a second spring with a second predetermined force, operation of the tool-actuating device removing the action of the second predetermined force, whereby the valve is thereafter held closed by the first predetermined force regardless of sustained operation of the tool-actuating device, thereby to provide a predetermined pressure at which the valve acts as a pressure relief valve as aforesaid.

2. A riveting tool as claimed in claim 1, in which release of the tool-actuating device firstly switches off the electric motor to stop operation of the pump, and then opens the inlet valve.

3. A riveting as claimed in claim 1, in which the riveting head is adapted to place blind breakstem rivets.

4. A riveting tool as claimed in claim 1, in which after the motor has been operated to actuate the riveting head as aforesaid and is then switched off, the riveting head is returned to its initial position by means independent of the head actuating means.

5. A riveting tool as claimed in claim 4, in which the head is returned to its initial position by means of a spring.

6. A riveting tool as claimed in claim 1, in which the electric motor, in use, rotates in only one direction.

7. A riveting tool as claimed in claim 1, in which the hydraulic pump is a reciprocating pump.

* * * * *

UNITED STATES PATENT AND TRADEMARK OFFICE

CERTIFICATE OF CORRECTION

PATENT NO. : 6,886,226 B1
APPLICATION NO. : 10/089490
DATED : May 3, 2005
INVENTOR(S) : Aiden R. Dear et al.

It is certified that error appears in the above-identified patent and that said Letters Patent is hereby corrected as shown below:

On the title page, item:
(75) "Robert A. Dear" should be -- Aiden R. Dear --
"Egbert Frenken, Wermelskirchen (DE)" should be
-- Egbert Frenken, Heinsberg, (DE) --

Signed and Sealed this

Twenty-second Day of May, 2007

JON W. DUDAS
*Director of the United States Patent and Trademark Office*